United States Patent [19]

Scoville

[11] 4,196,068

[45] Apr. 1, 1980

[54] CHLORINE GAS PRODUCING APPARATUS

[76] Inventor: Frank J. Scoville, 4646 S. 3075 East, Salt Lake City, Utah 84117

[21] Appl. No.: 919,124

[22] Filed: Jun. 26, 1978

[51] Int. Cl.[2] ..... C25B 9/04; C25B 11/03; C25B 11/10; C25B 1/26

[52] U.S. Cl. ..... 204/255; 204/256; 204/284; 204/290 F; 204/292; 204/293; 204/98; 204/128

[58] Field of Search ..... 204/257-258, 204/128, 269-270, 284, 290 F, 292-293, 254-256, 279, 98

[56] References Cited

U.S. PATENT DOCUMENTS

| | | | |
|---|---|---|---|
| 1,875,310 | 8/1932 | Youtz | 204/258 X |
| 3,668,005 | 6/1972 | Sluse et al. | 204/290 F X |
| 3,972,796 | 8/1976 | Fröhler et al. | 204/269 |
| 4,025,405 | 5/1977 | Dotson et al. | 240/258 X |
| 4,029,565 | 6/1977 | Bender et al. | 240/256 |
| 4,057,474 | 11/1977 | Kurtz et al. | 204/257 X |
| 4,062,743 | 12/1977 | Ahn et al. | 204/128 X |
| 4,105,529 | 8/1978 | Pohto | 204/279 X |

FOREIGN PATENT DOCUMENTS

| | | | |
|---|---|---|---|
| 2624694 | 12/1976 | Fed. Rep. of Germany | 204/257 |

*Primary Examiner*—John H. Mack

*Assistant Examiner*—D. R. Valentine

*Attorney, Agent, or Firm*—Criddle & Western

[57] ABSTRACT

Apparatus for producing chlorine gas comprising a plurality of separately housed electrolytic cells containing bimetallic electrodes electrically connected in series. Each electrolytic cell is divided into an anode and a cathode compartment separated by an ion permeable membrane which is impermeable to gases and water. Each cell housing contains passageways for simultaneously delivering a pure alkali metal chloride brine solution to the anode compartments and transporting chlorine gas produced at the anode and spent brine solution from the anode compartments. Passageways are also provided in each cell housing for delivering deionized water to the cathode compartments and conveying hydrogen gas produced at the cathode and an alkali metal hydroxide solution from the cathode chamber. Approporiate piping is provided for delivering brine solution and deionized water to the cell housing and conveying chlorine gas and spent brine and hydrogen gas and an alkali metal hydroxide solution from the cell housing. A positive direct current is supplied to the anode of one end cell of the apparatus and a negative direct current is supplied to the cathode at the other end cell of the apparatus.

8 Claims, 4 Drawing Figures

CHLORINE GAS PRODUCING APPARATUS

BACKGROUND OF THE INVENTION

This invention relates to an efficient, compact apparatus for producing chlorine gas or a hypochlorite compound, if such is desired.

The production of a chlorine releasing compound such as chlorine gas or a hypochlorite is important for a number of reasons. These compounds are used for sanitation purposes, providing commercial bleaches, as oxidizing agents, and for the use of purification or disinfecting of swimming pool water and individual ponds. Perhaps the most economical method of producing chlorine and/or hypochlorite compounds involves the application of an electric current to an alkali or alkaline earth metal chloride solution. In general, the resulting reaction yields the desired chlorine gas at the anode, and hydrogen gas and an alkali or alkaline earth metal hydroxide at the cathode according to the following equation wherein sodium is used as the metal:

$$2Na^{+} + 2Cl^{-} + 2H_2O \rightarrow 2Na^{+} + 2OH^{-} + Cl_2 + H_2 \quad (1)$$

Present arrangements for producing chlorine gas in this manner typically employ pairs of electrodes disposed in separate cells containing salt (usually sodium chloride) brine solution. Other arrangements may employ a number of electrodes disposed in a single cell with the electrodes connected in parallel. In the latter arrangement, a fairly high D.C. current but low voltage must be applied to the electrodes to cause electrolysis to take place thereby producing a chlorine gas in the cell. The fairly high current is required since the electrodes are connected in parallel and a certain amount of current must be applied to each electrode before the gas producing reaction will take place. Along with the higher current requirement, a lower voltage is also required, and this would be obtained from a conventional A.C. source using some type of a step-down transformer. The combination of the high current requirement and a low voltage requirement gives rise to a need for fairly large conductors to carry the current, rectifiers having large current carrying capacity, and fairly large transformers for "stepping-down" the voltage.

U.S. Pat. No. 3,835,020, issued Sept. 10, 1974, discloses a chlorine producing apparatus wherein the electrodes are connected in series and allegedly result in the production of chlorine, oxygen and hydrogen. No separation is made in the electrode chambers into anode and cathode compartments, and hence, all products produced as a result of the electrolysis reaction are intermixed and vented by the same exit port. Since chlorine reacts readily with hydrogen to form hydrogen chloride, it is questionable whether, when mixed with an aqueous solution, the apparatus would produce any usable chlorine compound for purification purposes instead of producing hydrochloric acid.

U.S. Pat. No. 3,962,065 issued June 8, 1976 teaches a carbon electrode chlorine gas generating system using carbon electrodes connected in series. The carbon electrodes comprise the bulk of the apparatus and are less efficient than metal electrodes. Moreover carbon electrodes are subject to breaking by any sharp impact that might strike the electrode housing.

When introducing chlorine or a hypochlorite into water for water treatment purposes, there are a variety of standard textbook chemical reactions that can and do take place. When chlorine gas is introduced into a water solution for chlorine molecule per se may interact with contaminants contained in the water supply. On the other hand, chlorine in water reacts according to Equation 2 to form hypochlorous acid and hydrogen chloride according to the following equation:

$$Cl_2 + 2H_2O \rightarrow HOCl + HCl + H_2O \quad (2)$$

Hypochlorous acid in turn reacts as shown in Equation 3 to form hydrogen chloride and nascent oxygen:

$$HOCl + H_2O \rightarrow HCl + O_2 + H_2O \quad (3)$$

It is the interaction of the nascent oxygen with the contaminants in the water which brings about additional purification. Thus is can be readily seen that in many instances it is desirable to introduce chlorine gas directly into a water supply so that both chlorine and oxygen may be used for purification purposes.

In certain instances, it may be desirable to use a hypochlorite as the disinfecting or purification reagent. When the electrolysis products from Equation (1) are combined, chlorine reacts with sodium hydroxide or other alkali or alkaline earth metal hydroxides to form sodium hypochlorite or the appropriate alkali or alkaline earth metal hypochlorite and a metal salt according to Equation (4) wherein sodium is shown as the metal:

$$Cl_2 + 2NaOH \rightarrow NaOCl + NaCl + H_2O \quad (4)$$

The more alkaline the solution is, the more rapid the conversion of chlorine into the hypochlorite will be. Sodium hypochlorite in aqueous solution forms sodium chloride and nascent oxygen according to Equation (5):

$$2NaOCl + H_2O \rightarrow 2NaCl + O_2 + H_2O \quad (5)$$

The oxygen released interacts with contaminants in the water or serves as an oxidizing agent as desired thereby bringing about water purification or the desired oxidation reaction.

In many instances, such as in applying a purification reagent to a swimming pool, the application of the chemicals can be both dangerous as well as inefficient and time consuming. Direct contact of a concentrated hypochlorite solution or chlorine gas with the skin may produce a serious skin irritation requiring immediate medical attention.

When applied to sewage plant or other contaminated sources, the supply of chlorine gas may be inadequate. In the case with the commercial or home swimming pool, the supply of chlorine may be improperly minitored.

SUMMARY OF THE INVENTION

It is an object of the present invention to provide an efficient, simple, and compact apparatus for producing chlorine gas or, if desired, a hypochlorite compound utilizing electrodes connected in series wherein the anode and cathode are made of different metallic materials.

It is a further object of the present invention to provide a chlorine producing apparatus in which a plurality of electrodes are arranged in series with electrode cells being divided by an ion permeable membrane into cathode and anode compartments and wherein the cathode and anode are made from different metallic materials.

It is also an object of the present invention to provide a chlorine producing apparatus wherein the permeable membrane is a solid polymer electrolyte which will allow the passage of ions but is impermeable to gases and liquids.

It is another object of the present invention to provide a chlorine producing apparatus wherein the chlorine can be withdrawn in the gaseous stage from the anode compartment into passageways in the cell housing, and hydrogen and an alkali metal hydroxide can be withdrawn from the cathode compartment into a passageway in the cell housing, and the products thus passing out of said housing are collected.

It is still another object of the present invention to provide a chlorine producing apparatus wherein the cathode and anode compartments are separated by a solid polymer electrolyte, and the electrolytic cells are separately housed.

The above and other objects and advantages of the present invention are realized in a specific embodiment which includes a plurality of separate electrolytic cells electrically interconnected and containing means for simultaneous introduction of reactants and removal of reaction products and wastes. The cells are in turn divided by a chloride ion permeable membrane into an anode and cathode chamber or compartment. The ion permeable membrane is preferably a solid polymer electrolyte which is impermeable to fluids as will be more fully defined hereinafter.

The cell housings are made of a nonconductive material such as high impact polyvinyl chloride or polyolefin. Each cell housing consists of two pieces of similar proportions fastened together in a fluid tight relationship having a flat outside and a hollowed out inside which defines an electrode compartment or chamber. These chambers are sized such to receive the anode and cathode. One of these pieces preferably has a groove around the outer perimeter adjacent the electrode compartment adapted to frictionally hold a membrane retainer such as a strip of nonconductive material. The membrane fits over the compartment at that point and is securely fastened in a taut position by the membrane retainer being frictionally fitted into the grooves. Each piece has an aperture in the center into which the electrode is anchored. An electrode stem protruding through the aperture serves as a means by which one cell can be electrically connected to an adjacent cell. Throughout the perimeter of the cell housing, are passageways leading into the anode and cathode compartments which define entrance and exit ports for a pure alkali chloride brine solution, deionized water, chlorine gas and spent brine solution, and hydrogen gas accompanied with an alkali metal hydroxide solution. At the bottom of the cell housing the passageways or apertures leading in to the electrode compartments communicate with outside piping for the introduction of a pure alkali metal salt brine solution into the anode compartment and deionized water into the cathode compartment. The electrolysis reaction which takes place at the anode produces chlorine gas which exits through a larger aperture at the top of the anode compartment along with spent brine solution into outside piping from which the chlorine gas can be collected. The alkali metal ion, i.e., sodium or potassium, which was introduced into the anode compartment as a chloride salt, passes through the ion permeable membrane. The chloride ion is attracted to the anode and chloride ions not converted to chlorine gas exits as spent brine solution along with its corresponding metal ion. In the cathode compartment electrolysis further takes place releasing hydrogen gas and converting the alkali metal ion into its corresponding hydroxide. The hydrogen gas and alkali metal hydroxide solution then exit out the aperture at the top of the cathode compartment into appropriate piping and are collected. It is at this point that, if a hypochlorite solution is desired, the alkali metal hydroxide and chlorine gas are brought into contact with each other whereby an alkali metal hypochlorite is formed according to Equation (4). The apparatus has means at either end for supplying a D.C. current in series to the electrodes as described.

DRAWINGS

DETAILED DESCRIPTION OF THE INVENTION

Figure 1:
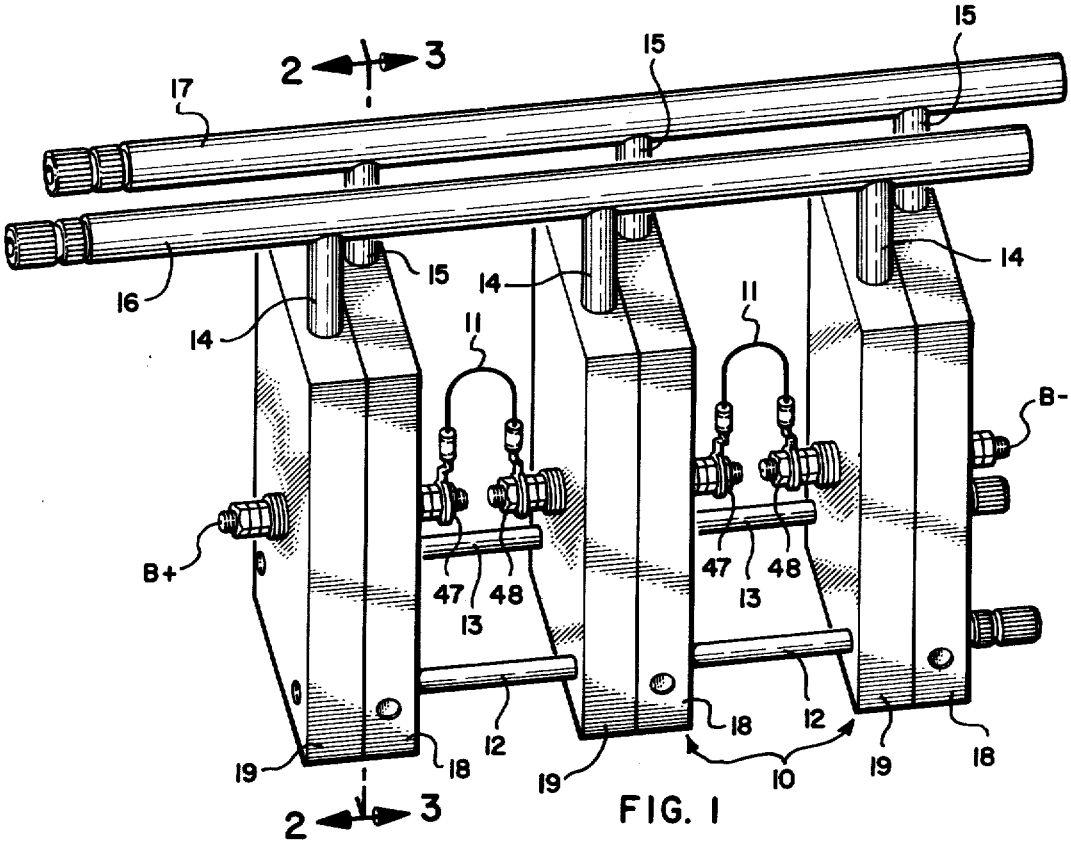
FIG. 1 is a perspective view of the apparatus showing the electrical connections between the separate cells and the external plumbing for conveying solutions to and from the cells.

An operative embodiment of the apparatus of the present invention is shown in FIGS. 1 through 4. FIG. 1 shows the assembled apparatus consisting of a plurality of electrolytic cells 10 electrically interconnected by wires 11 and joined together at the bottom by feeder lines 12 and 13 which pass through the cell housing and by discharge lines 14 and 15 which lead from the cell housing to collection lines 16 and 17.

Figure 2:
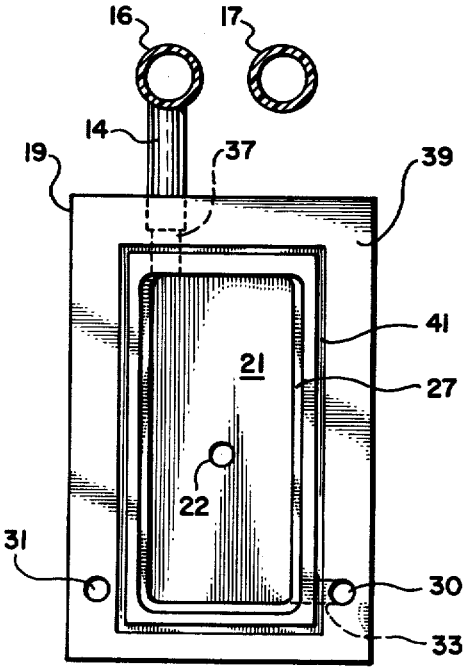
FIG. 2 is a cross-sectional view taken along line 2—2 of FIG. 1 showing a cathode compartment without the cathode or membrane.
Figure 3:
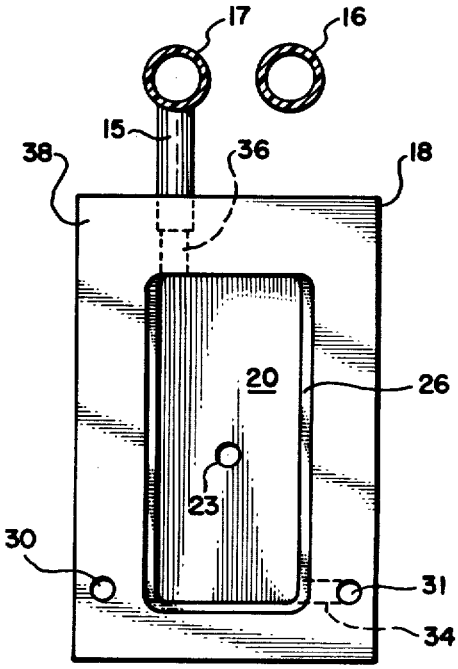
FIG. 3 is a cross-sectional view taken along line 3—3 of FIG. 1 showing an anode compartment without the anode.
Figure 4:
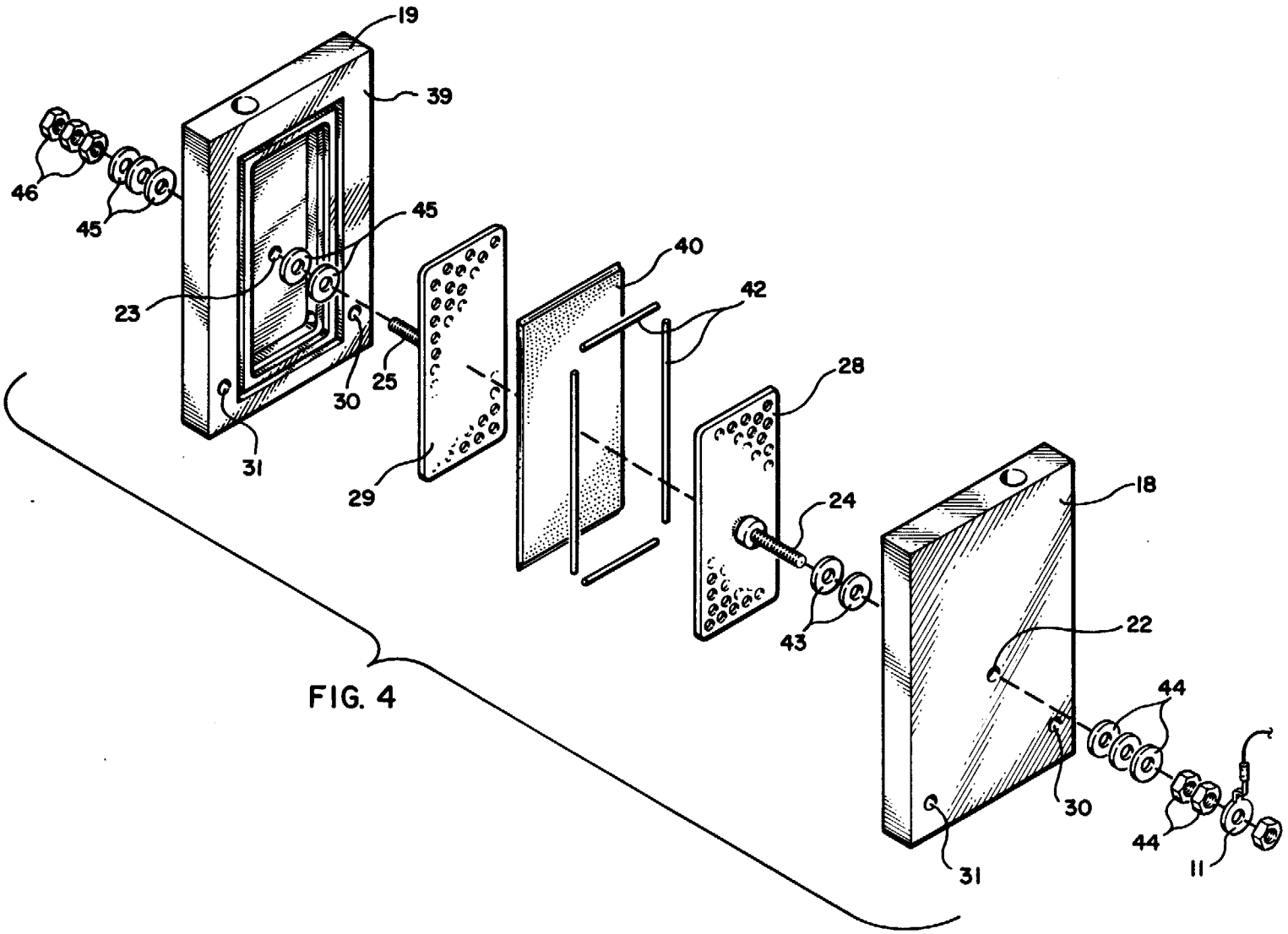
FIG. 4 is an exploded view of one complete electrolytic cell.

Each electrolytic cell is the same in structure and is shown in detail in FIGS. 2, 3 and 4. Each cell housing consists of two parts, the anode housing 18 and the cathode housing 19, which are substantially the same in structure. The anode and cathode housing 18 and 19 are made of non-conductive material and may be of any desired shape but for the purpose of this disclosure are shown to be rectangular. The outside of each housing is flat but the inside contains a central cavity defining an anode compartment 20 and a cathode compartment 21. An aperture 22 and 23 is contained in the center of the cathode and anode compartment through which the anode or cathode connections 24 and 25 may protrude. A setp 26 and 27 surrounds all or part of the anode and cathode compartments against which the anode 28 and cathode 29 may be seated. The depth of the step is predetermined so that the anode 28 and cathode 29, when seated and the anode and cathode housings are joined together, will be properly spaced to prevent arcing and provide maximum efficiency.

Apertures 31 and 30 adapted to receive feeder lines 12 and 13 extend through each housing wall adjacent the electrode compartments. Apertures in brine feeder line 12 are in register with a brine inlet aperture 37 in the anode housing leading into anode compartment 20. The brine inlet aperture 34 is at right angles to and connects aperture 30 with cathode compartment 21. Apertures in water feeder line 13 passing through aperture 30 are in register with the water inlet aperture 32 in each cathode housing. An outlet 36 through the perimeter 38 of the anode housing is adapted to receive a chlorine-spent brine solution through discharge line 15 connecting anode compartment 20 with collection line 17. A similar outlet 37 in the cathode housing perimeter 39 is adapted to receive a hydrogen-alkali metal hydroxide discharge line 14 connecting cathode compartment 21 with collection line 16.

Tautly stretched over either the anode or cathode compartment is a thin ion permeable, gas and liquid impermeable membrane 40. FIGS. 2 and 4 show the cathode housing 19 adapted to hold membrane 40. As shown in these Figs., there is a groove 41 around the perimeter 39 of the cathode housing 19 adjacent the cathode compartment 21. The membrane 40 is laid over the cathode compartment 21 and grooves 41 and a membrane retainer 42 is frictionally forced into the grooves thereby stretching and securing the membrane 40 in a taut position over the cathode compartment. Thus, when the anode and cathode housings are sealed together by securing the perimeter surfaces of the anode and cathode housings to each other in a fluid tight relationship the anode 28 and cathode 29 will be separated by the membrane 40 in a fixed spacial relationship.

The anode 28 and cathode 29 are made of different metals or combinations of metals. The preferred anode is a ruthenium oxide covered titanium in sheet form having apertures therein to increase the surface area. Such electrodes are often referred to as DSA (dimensionally stable anode) such as marketed by Electrode Corporation, a subsidiary of Diamond Shamrock Corporation. Conventional carbon electrodes have the tendency to wear away and thereby increase distance between the anode and cathode whereby a DSA anode remains stable. Other electrodes which can be used to advantage are platinum coated materials such as titanium, tanalum and columbium (niobiom). The cathodes are an apertured sheet metal preferably made of stainless steel. Other cathodes made of copper, copper alloys, nickel alloys, milk steel and iron may also be used. The connectors 24 for the anode are preferably titanium bolts welded to the anode. The cathode connectors are preferably stainless steel bolts 25 welded to the cathode.

The ion permeable membrane 40 is wetted by the brine solution, but will not allow the passage of water therethrough. Thus, the membrane 40 is only permeable to ions, and positive ions in particular, since the negative ions will be attracted to the anode when an electrical charge was applied to the apparatus. The preferred membrane is a solid polymer electrolyte (SPE) which is typically a solid plastic sheet of a perfluorinated sulfonic acid polymer. Such a membrane is described, for example, in *Chemical and Engineering News* Aug. 27, 1973, in an article entitled "Solid Electrolytes Offer Route to Hydrogen" and in U.S. Pat. Nos. 3,784,399 and 3,969,285. The ionic conductivity of these membranes result from the mobility of the ion, the cations such as sodium and potassium in particular, which moves through the polymer sheet from the anode compartment 20 to the cathode compartment 21. A preferred membrane 40 is a perfluorinated sulfonic acid polymer produced by Dupont and is known under the tradename "Nafion". "Nafion" membrane is described in an article entitled "Nafion, and Electrochemical Traffic Controller" by Vaughan, published in *Dupont Innovation*, Volume 4, No. 3, Spring 1973.

The assembly of each electrolytic cell 10 can be visualized from FIGS. 2, 3 and 4. Anode 28 is seated into anode chamber 20 of anode housing 18 with anode connecting post 24 extending through aperture 23 and washers 43. The anode 28 is securely held in anode chamber 20 by screwing nuts 44 on connecting post 24 until tight. Similarly cathode 29 is seated in cathode chamber 21 of housing member 19 with cathode connecting post 25 passing through washers 45 and aperture 22. Cathode 29 is secured in anode chamber 21 by screwing nuts 46 on connecting post 25 until tight. A sealant may be placed about connecting posts 24 and 25 passing through apertures 22 and 23 in order to render the housing with chemically inert and impermeable to fluids. Membrane 40 is tautly secured in groove 41 by retainers 42. With the anode 28 and cathode 29 secured within their respective housings 18 and 19 the facing perimeters 38 and 39 are glued together to form an integrated electrolytic cell 10. As shown in FIG. 1, a plurality of cells are joined together by inserting brine feeder line 12 through aperture 31 and water feeder line 13 through aperture 30 of the cells. Discharge lines 13 and 14 are inserted into apertures 36 and 37 and connected to collection lines 7 and 16. Connecting wires 11 are secured to each electrode post by nuts 47 and 48. The outside anode connecting post 24 is connected to a positive D.C. electric current $B^+$ and at the other end of the apparatus connecting post 25 is connected to a negative D.C. electric current $B^-$. Any plurality of electrolytic cells may be joined together depending upon the chlorine generating capacity desired.

In operation, a pure alkali chloride solution, i.e., preferably sodium chloride, is introduced through brine feeder line 12 into each electrolytic housing and flows through inlets 34 into anode compartments 20. By application of a direct current source, electrolysis takes place at the anode 28 causing the production of chlorine gas and sodium ions. The chlorine gas and spent salt brine solution exit via outlet 36 into passageway 15 and collection line 17 wherein the chlorine gas and spent salt brine solution pass into a separation unit (not shown) whereby chlorine gas is released and the spent brine is disposed of.

The alkali metal ions, i.e., sodium or potassium from the anode compartment migrate through the solid polymer electrolyte membrane 40 into the cathode compartment 21. The cathode compartment contains deionized water which has entered compartment 21 via inlet 33 from feeder line 13. Electrolysis also takes place at the cathode 29 producing hydrogen gas from the deionized water resulting in the production of both hydrogen gas and an alkali metal hydroxide, i.e., sodium hydroxide of potassium hydroxide. Since the deionized water and alkali metal chloride solutions are free of alkaline earth ions such as calcium and magnesium, there is no deposition of these metals in the form of oxide of hydroxide on the cathode thus extending the life of the cathode for essentially infinite operation. The hydrogen gas thus generated along with the alkali metal hydroxide solution exit via port 37 into passageway 14 and collection line 6 whereby these products are separated, collected, or otherwise disposed of. As previously mentioned, if desired, the alkali metal hydroxide and chlorine gas can be reacted to form an alkali metal hypochlorite depending upon the end use desired.

The materials utilized in constructing the apparatus of the present invention must be resistant to the action of chlorine, and of each electrolytic compartment must be completely sealed from the adjacent compartment other than by the apertures leading in from the various passageways.

When the alkali metal chloride brine solution is supplied to the anode compartments, and the positive and negative D.C. current is applied to each respective end most one of the electrodes, the electrodes are coupled in what may be termed a series electrical circuit. The reaction that takes place then involves the conversion of chloride ions in the salt brine solution into chlorine gas at the interface between the anode and the salt brine solution, and the reaction at the interface of the cathode produces hydrogen gas and an alkali metal hydroxide.

For optimum operation the electrodes are spaced about ¼ inch apart. If the electrodes are too close together arcing will occur and the electrodes will short out. There must be sufficient room between the electrodes to provide for the membrane and to allow fluid circulation within each electrode compartment between the membrane and the electrode. The temperature within each cell can be controlled by varying the flow rate of brine solution and deionized water through the unit. Since the flow rate of brine solution will be adjusted to provide for maximum conversion of the alkali metal chloride into chlorine the temperature adjusting variable will be the flow rate of deionized water. Generally the apparatus will operate at temperatures between about 25° and 75° C. Obviously, flow volume will be dictated by the number and size of electrolytic cells in operation.

Voltage applied will be a function of required current density. A distinct advantage of the bimetallic electrodes over carbon electrodes is that a lower current density may be utilized thus allowing for cooler temperatures within each cell at comparable flow rates. Current densities of 0.5 to 10 amps/in$^2$ may be utilized.

The capacity of each unit may be easily selected by determining the number of cells to be utilized. Operational parameters, i.e. voltage, temperatures, flow volume and rate, may be empirically determined by one having ordinary skill in the art.

If for any reason, a cell forming part of a unit should become inoperative that cell may be electrically bypassed. If preferred, a cell may be removed, replaced or new cells added simply by cutting the piping connecting a cell to the unit and by use of sleeves, interconnecting the piping of the remaining cells and any added cells in a fluid tight relationship and electrically joining adjacent cells as already taught.

While the invention, as has been described, is considered to be a preferred embodiment, other variations or equivalents may be used including changes in the shape and positioning of the housing, passageways, electrode materials, housing materials, electrode shape and the like without departing from the scope of this invention which is to be limited only by the claims appended hereto.

I claim:

1. An apparatus for electrolytically producing chlorine gas comprising a series of separately housed electrolytic cells interconnected by feeding means for simultaneously introducing an alkali metal chloride brine solution to an anode compartment in each of said cells and feeding means for simultaneously introducing deionized water to a cathode compartment in each of said cells and by collecting means for simultaneously collecting chlorine gas and spent brine solution from the anode compartment in each of said cells and collecting means for simultaneously collecting hydrogen and an alkali metal hydroxide solution from the cathode compartment in each of said cells, wherein each of said cells are divided into anode and cathode compartments by an ion permeable membrane, which membrane is impermeable to water and gas; said anode compartments containing an anode having a connecting post seated therein and having an inlet passageway which allows introduction of the alkali metal chloride brine solution into the lower portion of the anode compartment from the appropriate feeding means, and an outlet passageway which allows chlorine gas produced at the anode along with spent brine solution to be withdrawn to the appropriate collecting means; said cathode compartment containing a cathode having a connecting post seated therein and having an inlet passageway which allows introduction of deionized water into the lower portion of the cathode compartment from the appropriate feeding means, and an outlet passageway which allows the hydrogen gas produced at each cathode and alkali metal hydroxide solution produced in the cathode compartment to be withdrawn to the appropriate collecting means; said apparatus also containing means for supplying a positive D.C. source to the anode at one end of the series of electrolytic cells and a negative D.C. source at the opposite most end cathode in the series of electrolytic cells, the anode in each of said cells being made of one metal and the cathode being made of a different metal, the cathode post from one cell being electrically connected to the anode post of an adjacent cell by a flexible detachable interconnecting electrical wire.

2. A chlorine producing apparatus according to claim 1 wherein each separately housed electrolytic cell comprises fastened together in combination, (a) an anode housing having a backwall and outer sidewalls which along with the ion permeable membrane, define the anode compartment said backwall having a center aperture through which the connecting post of the anode may be inserted, said sidewalls containing one aperture for introducing the alkali metal chloride brine solution to the anode compartment and a second aperture for withdrawing the chlorine and spent brine solution from the anode compartment, (b) a cathode housing having a backwall and outer sidewalls which, along with the ion permeable membrane, define the cathode compartment said backwall having a center aperture through which the connecting post of the cathode may be inserted, said sidewalls containing one aperture for introducing deionized water to the cathode compartment and a second aperature for withdrawing the hydrogen and alkali metal hydroxide solution from the cathode compartment, wherein said anode housing and cathode housing are joined together in a fluid tight facing relationship such that the ion permeable membrane divides the anode compartment from the cathode compartment.

3. A chlorine producing apparatus according to claim 2 wherein the ion permeable membrane is a solid polymer electrolyte.

4. A chlorine producing apparatus according to claim 3 wherein the ion permeable membrane is a perfluorinated fluorinated sulfonic acid polymer.

5. A chlorine producing apparatus according to claim 3 wherein the anodes and cathodes are in the form of perforated sheets.

6. A chlorine producing apparatus according to claim 5 wherein the anode is selected from the group consisting of a ruthenium oxide coated titanium metal or a platinum coated titanium, tantalum or columbium metal.

7. A chlorine producing apparatus according to claim 6 wherein the cathode is selected from the group consisting of stainless steel, copper, copper alloys, nickel alloys, mild steel, and iron.

8. A chlorine producing apparatus according to claim 7 wherein the anode is a ruthenium oxide coated titanium metal and the cathode is a stainless steel.

* * * * *